US007168976B1

(12) United States Patent
Huang

(10) Patent No.: US 7,168,976 B1
(45) Date of Patent: Jan. 30, 2007

(54) SOFT PC BOARD CONNECTOR

(75) Inventor: Alex Huang, Taipei (TW)

(73) Assignee: Cvilux Corporation, Danshue Township, Taipei County (TW)

( * ) Notice: Subject to any disclaimer, the term of this patent is extended or adjusted under 35 U.S.C. 154(b) by 0 days.

(21) Appl. No.: 11/256,772

(22) Filed: Oct. 25, 2005

(51) Int. Cl.
*H01R 12/24* (2006.01)

(52) U.S. Cl. ..... 439/495

(58) Field of Classification Search ..... 439/495, 439/492, 260
See application file for complete search history.

(56) References Cited

U.S. PATENT DOCUMENTS 6,921,274 B2 * 7/2005 Yu ..... 439/260
2004/0023551 A1 * 2/2004 Suzuki et al. ..... 439/495
2004/0067679 A1 * 4/2004 Maejima ..... 439/495
2004/0180572 A1 * 9/2004 Chiu ..... 439/495
2004/0235341 A1 * 11/2004 Chiu ..... 439/495
2005/0136732 A1 * 6/2005 Suzuki ..... 439/495
2005/0260885 A1 * 11/2005 Lu ..... 439/495

* cited by examiner

*Primary Examiner*—Tulsidas C. Patel
*Assistant Examiner*—Vladimir Imas

(57) ABSTRACT

A soft PC board connector comprises a seat. A rear half of the seat has a plurality of through holes; and a front side of the seat is formed with a plurality of terminal slots. A plurality of front insertion elastic sheets each integrally formed with a hook portion. A plurality of rear insertion elastic sheets each rear insertion elastic sheet is integrally formed with a hook portion, a contact nose, an SMT welding pin, and a recess for embedding a soft bank wire or a soft circuit board. The rear insertion elastic sheet is inserted into the through holes. A movable cover is capable of covering upon the terminal slots of the seat. One long side of the cover has a plurality of notches. Each notch is passed by a shaft for being received within the hook portion of the front insertion elastic sheet.

2 Claims, 7 Drawing Sheets

SOFT PC BOARD CONNECTOR

FIELD OF THE INVENTION

The present invention relates to electric connectors, and particularly to a soft PC board connector, wherein the present invention has the effect of firmly securing the soft bank wires or the soft circuit board so as to improve the defect in the prior art. Thereby the front insertion elastic sheets and rear insertion elastic sheets have the effect of preferred fixedness, strong stress and buckling effect so as to avoid the improper contact or loose of the soft bank wires or the soft circuit board.

BACKGROUND OF THE INVENTION

In the prior art electric connector is used to connect a bank wire with other electric device for transferring signals. The prior art electric connector includes a body made of insulating material, a plurality of terminals insertable into the body and made of metal, and movable fixing units which are connected to the terminals and made of insulating material so as to clamp and position a substrate.

However the prior art has the following disadvantages. Only two ends of the fixing unit are fixed. A middle section of each fixing unit is suspended so that it is easily bent and thus cannot be covered tightly. Thereby the substrate cannot has a well electric contact property. Furthermore, when the fixing unit is opened, it will contact with the contact points of the body. When the fixing units are over-opened, it will be broken. The body has a welded enhancing sheet which is only used in buckling connection. After it is used for a long time, the enhancing sheet will fall down. Moreover, since only two ends of the body are connected, the connecting portion has a C shape. The portion easily falls down due to vibration.

SUMMARY OF THE INVENTION

Accordingly, the primary object of the present invention is to provide a soft PC board connector, wherein the present invention has the effect of firmly securing the soft bank wires or the soft circuit board so as to improve the defect in the prior art. Thereby the front insertion elastic sheets and rear insertion elastic sheets have the effect of preferred fixedness, strong stress and buckling effect so as to avoid the improper contact or loose of the soft bank wires or the soft circuit board.

To achieve above object, the present invention provides a soft PC board connector. The connector comprises the following elements.

A seat has two lateral walls at two sides. A rear half of the seat has a plurality of through holes which are spaced arranged; and a front side of the seat is formed with a plurality of terminal slots.

A plurality of front insertion elastic sheets each integrally formed with a hook portion; an embedding portion, a protrusion, an SMT welding pin, a buckling trench, and a recess for embedding a soft bank wire or soft circuit board.

A plurality of rear insertion elastic sheets each rear insertion elastic sheet is integrally formed with a hook portion, a contact nose, an SMT welding pin, and a recess for embedding a soft bank wire or a soft circuit board. The rear insertion elastic sheet is inserted into the through holes. Each hook portion of the rear insertion elastic sheet is corresponding to a respective hook portion of the front insertion elastic sheet.

A movable cover is capable of covering upon the terminal slots of the seat. One long side of the cover has a plurality of notches. Each notch is passed by a shaft for being received within the hook portion of the front insertion elastic sheet and is hindered by the hook portion of the rear insertion elastic sheet. Thereby the cover is openable or closable along the round shaft.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the soft PC connector of the present invention is illustrated. The present invention includes the following elements.

Figure 1:
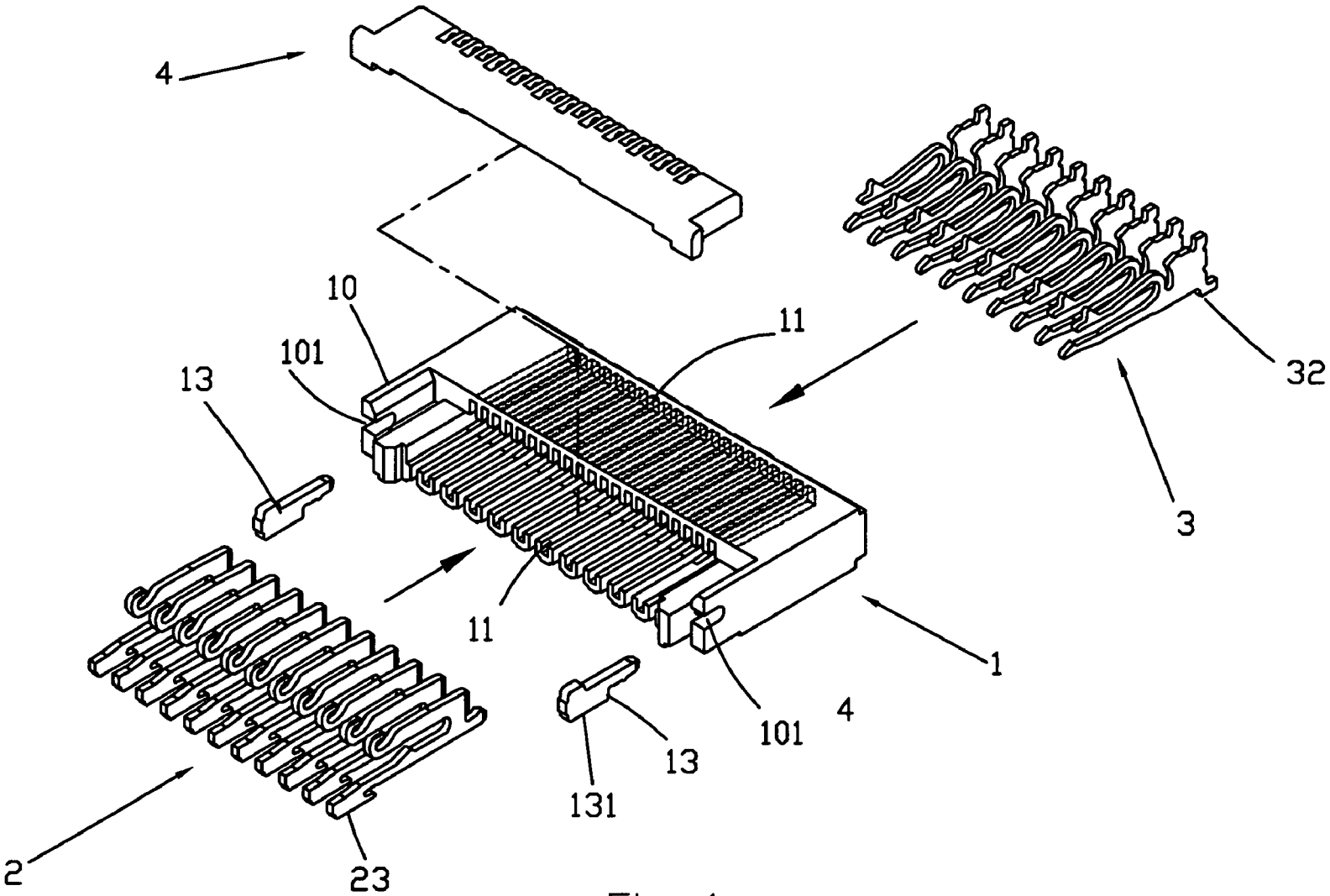
FIG. 1 is an exploded perspective view of the soft PC board connector of the present invention.

A seat 1 has two lateral walls 10 at two sides, see FIG. 1. A front half of each lateral wall 10 of the seat 1 has a notch 101. A rear half of the seat 1 has a plurality of through holes 11 which are spaced arranged. A front side of the seat 1 is formed with a plurality of terminal slots 12. A gap is formed between each lateral wall 10 and a lateral side of the plurality of terminal slots 12 for receiving a respective enhancing sheet 13. The enhancing sheet 13 has a welding portion 131 for SMT (surface mounting technology) operation.

Referring to FIG. 2B, a plurality of front insertion elastic sheets 2 are included. Each front insertion elastic sheet 2 is made of elastic insulating material and has integrally formed with a hook portion 20, an embedding portion 21, a protrusion 22, an SMT welding pin 23, a buckling trench 24, and a recess 25 for embedding a soft bank wire or soft circuit board. The front insertion elastic sheet 2 can be inserted into the terminal slot and is positioned therein by the embedding portion 21. After positioning, the hook portion 20, SMT welding pin 23, and buckling trench 24 are exposed out of the seat 1.

Figure 2:
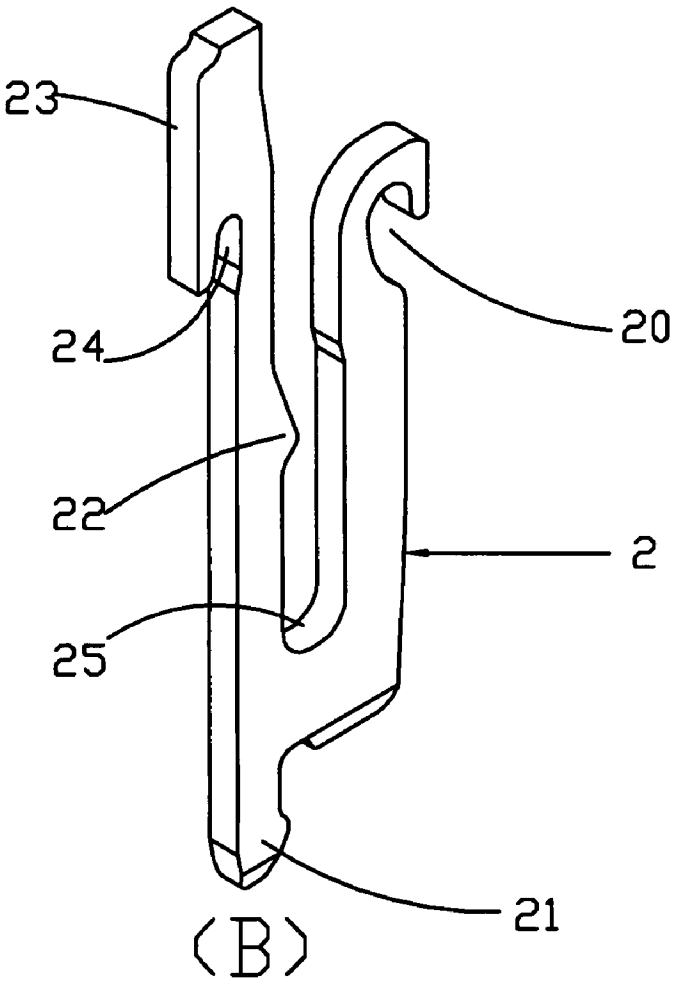
FIG. 2(A) is a perspective view about the rear insertion elastic sheet of the present invention.
FIG. 2(B) is a perspective view about the front insertion elastic sheet of the present invention.
Figure 2:
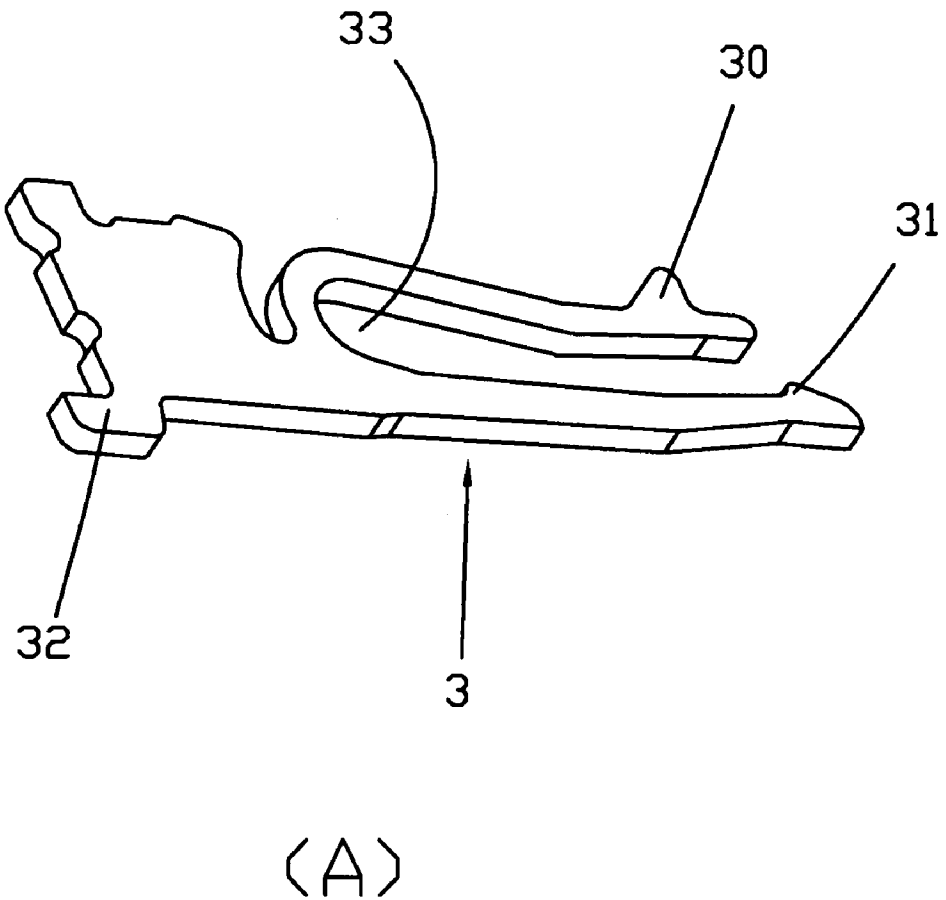
Figure 3:
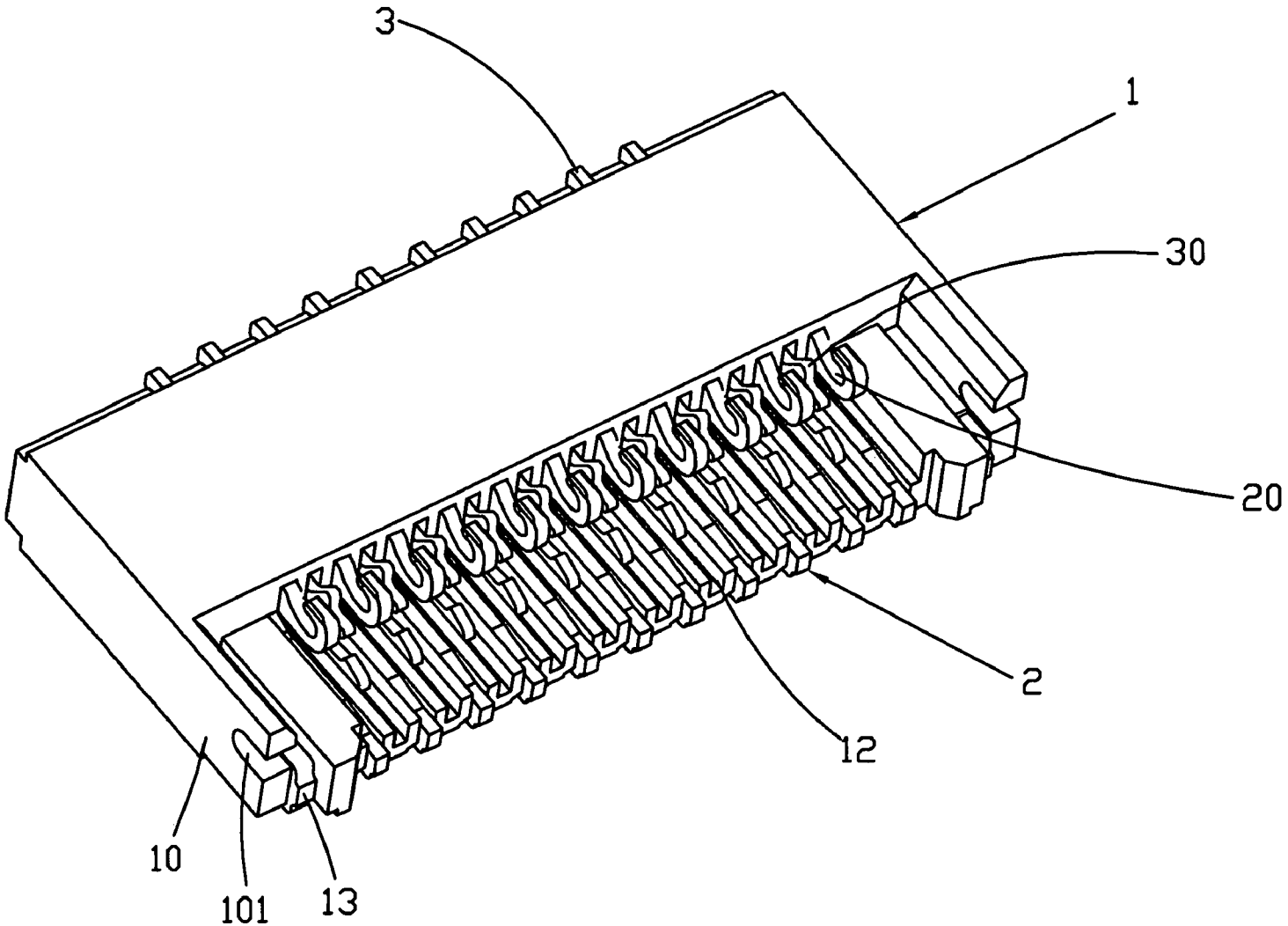
FIG. 3 is a perspective view about the soft PC board connector of the present invention without a cover.

A plurality of rear insertion elastic sheets 3 are included. Each rear insertion elastic sheet 3, as illustrated in FIG. 2, is made of elastic insulating material. The rear insertion elastic sheet 3 is integrally formed with a hook portion 30, a contact nose 31, an SMT welding pin 32, and a recess 33 for embedding a soft bank wire or soft circuit board 5. The rear insertion elastic sheet 3 can be inserted into the through holes 11. The hook portion 31 and the SMT welding pin 32 of the recess 25 to be alternatively arranged with the front insertion elastic sheets 2. Each hook portion 30 of the rear insertion elastic sheet 3 is corresponding to a respective hook portion 20 of the front insertion elastic sheet 2, see FIG. 3.

Figure 4:
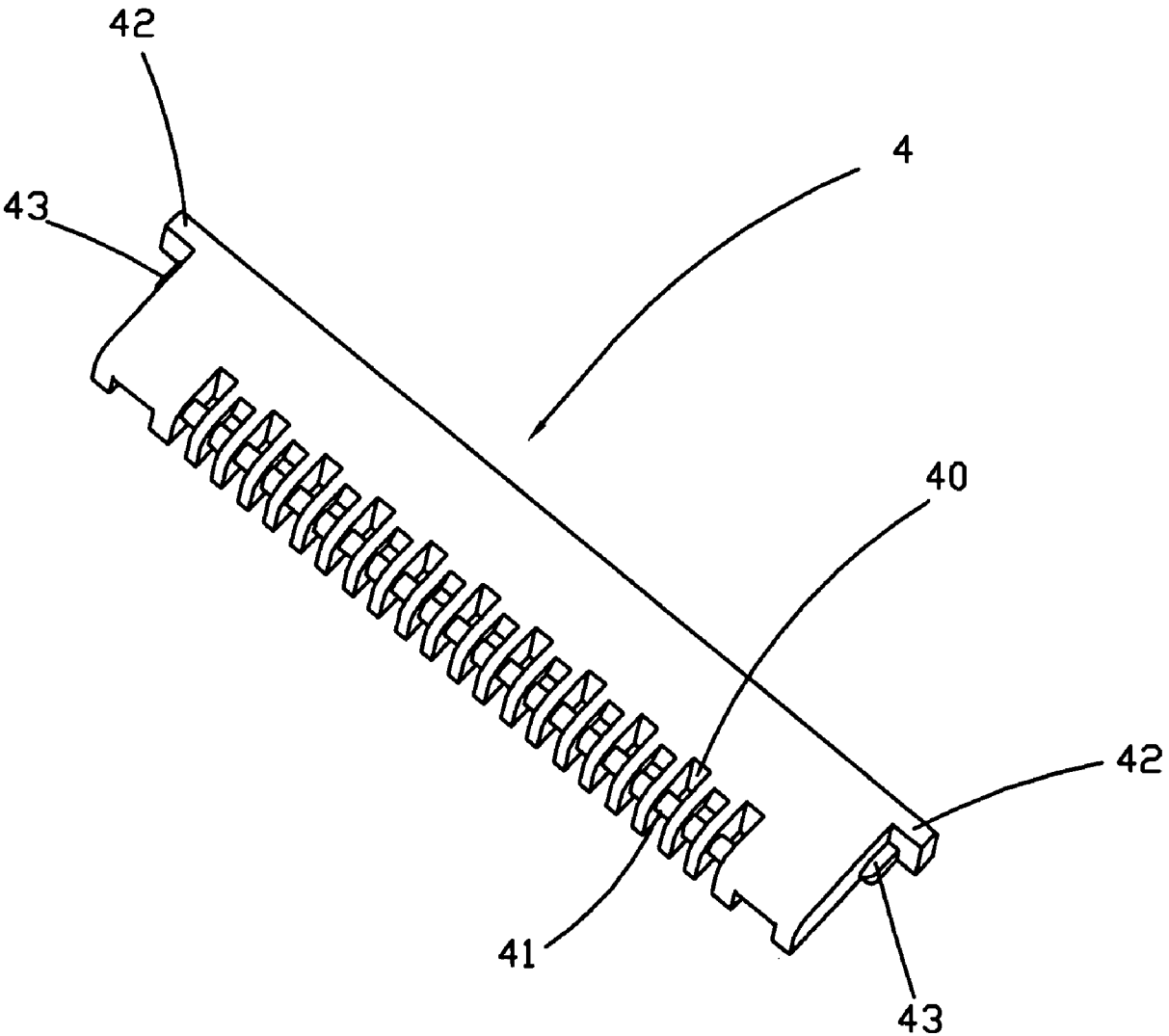
FIG. 4 is a perspective view about the soft PC board connector of the present invention with a cover.

A movable cover 4, referring to FIG. 4, is capable of covering upon the terminal slots 12 of the seat 1. One long side of the cover 4 has a plurality of notches 40. The number of the notches 40 is equal to that of the front insertion elastic sheets 2. Each notch 40 is passed by a round shaft 41 for being received within the hook portion 20 of the front insertion elastic sheet 2 and is hindered by the hook portion of the rear insertion elastic sheet 3. Thereby the cover 4 can be opened or closed along the round shaft 41. Each of two ends of a side opposite the side having the plurality of notches 40 has an ear 43. The ears 43 can be embedded into the notches 101 at the lateral walls 10 of the seat 1 so as to position the cover 4. A bottom of the cover 4 is an inclined surface so as to have a firmly electric contact between the cover 4 and the seat 1.

The sizes of the recesses 25 of the front insertion elastic sheets 2 and recesses 33 of the rear insertion elastic sheets 3 are greater than the thickness of the soft bank wires or the soft circuit board 5 so as to position the wire or circuit board 5 easily.

Figure 5:
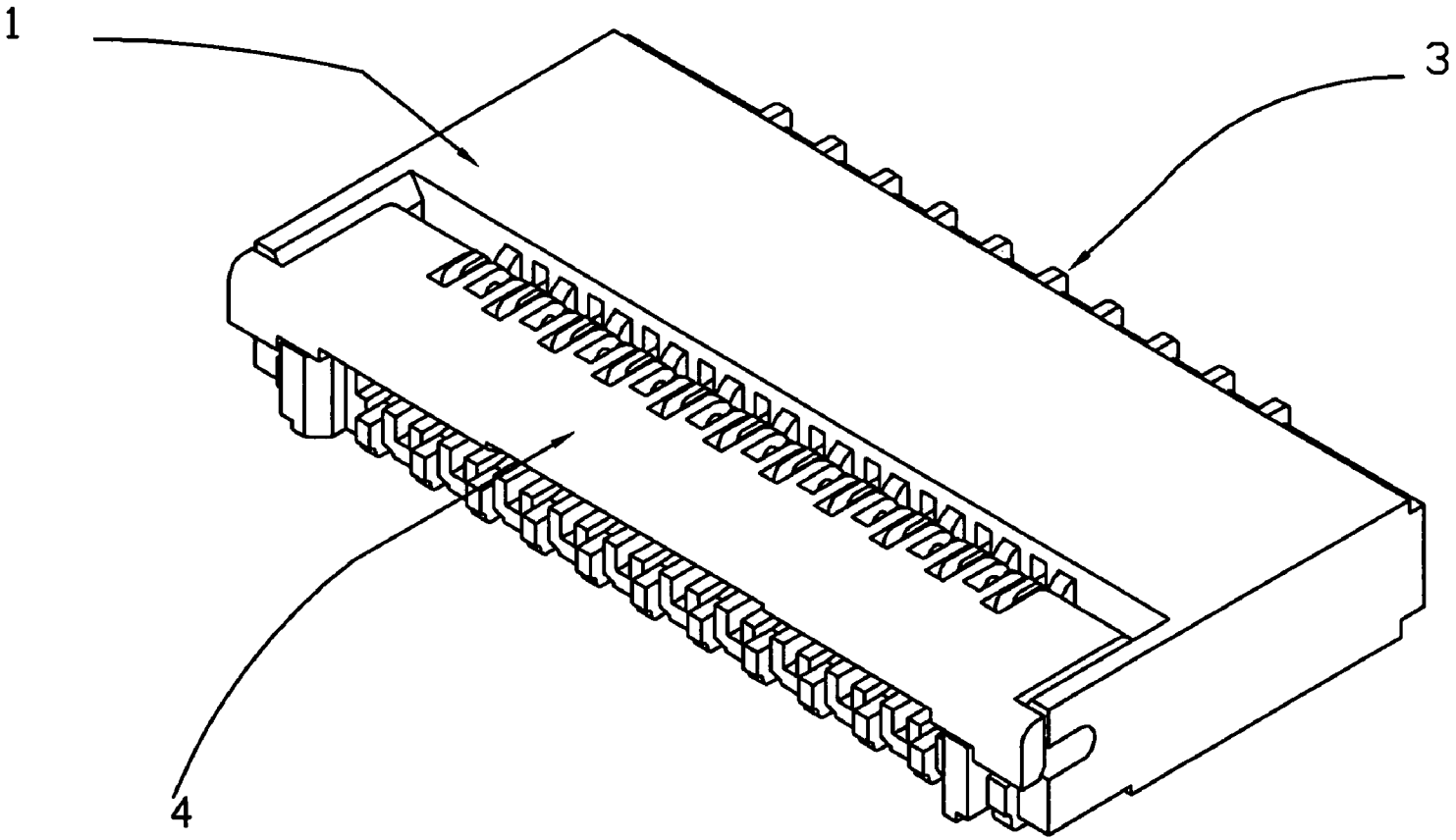
FIG. 5 is an assembly view of the soft PC board connector of the present invention.
Figure 6:
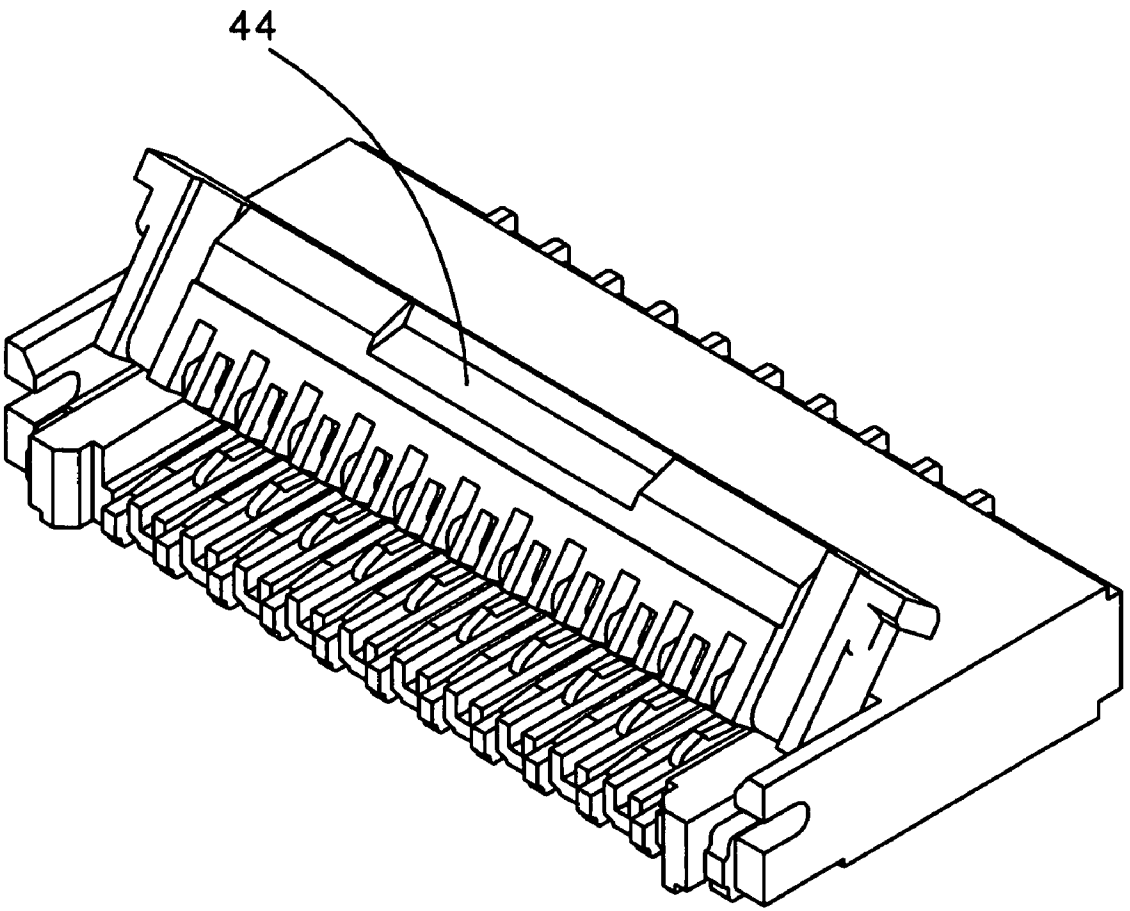
FIG. 6 is an assembled view of the present invention, where the cover is opened.

The assembly of the present invention is illustrated in FIGS. 5 and 6.

Figure 7:
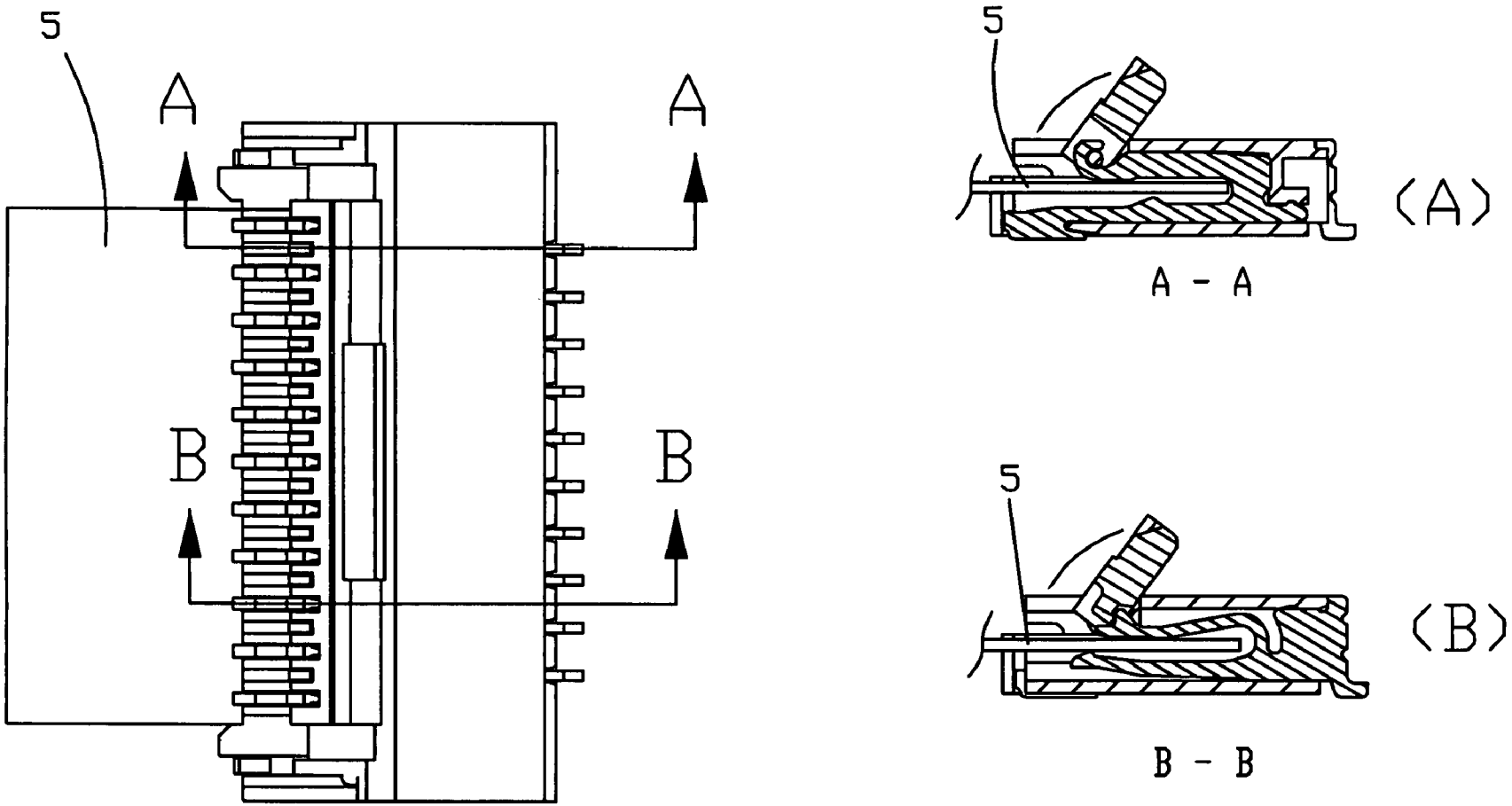
FIG. 7(A) is a longitudinal view about the soft PC board connector of the present invention.
FIG. 7(B) is a transversal view about the soft PC board connector of the present invention.

In use of the present invention, see FIG. 6, the cover 4 is opened, and the soft bank wires or the soft circuit board 5 are inserted into the recesses 25 of the front insertion elastic sheet 2 and the recesses 33 of the rear insertion elastic sheet 3. As illustrated in FIGS. 7A and 7B, the protrusions 22 of the front insertion elastic sheets 2 and the contact noses 33 of the rear insertion elastic sheets 3 have the effect of resisting the soft bank wires or the soft circuit board 5. When the cover 4 is closed, the round shaft 41 rotates so that the hook portions 20 and 30 move downwards. The recesses 25, 33 are reduced so that the front insertion elastic sheets and rear insertion elastic sheets 3 firmly contact and clamp the soft bank wires or the soft circuit board 5.

Thereby it is known that the present invention has the effect of firmly securing the soft bank wires or the soft circuit board so as to improve the defect in the prior art. Thereby the front insertion elastic sheets and rear insertion elastic sheets have the effect of preferred fixedness, strong stress and buckling effect so as to avoid the improper contact or loose of the soft bank wires or the soft circuit board.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A soft PC board connector comprising:

a seat having two lateral walls at two sides, a rear half of the seat having a plurality of through holes which are spaced arranged; a front side of the seat being formed with a plurality of terminal slots;

a plurality of front insertion elastic sheets; each front insertion elastic sheet being integrally formed with a hook portion; an embedding portion, a protrusion, an SMT welding pin, a buckling trench, and a recess for embedding a soft bank wire or a soft circuit board;

a plurality of rear insertion elastic sheets; each rear insertion elastic sheet being integrally formed with a hook portion, a contact nose, an SMT welding pin, and a recess for embedding a soft bank wire or a soft circuit board; the rear insertion elastic sheet being inserted into the through holes; each hook portion of the rear insertion elastic sheet being corresponding to a respective hook portion of the front insertion elastic sheet; and a movable cover capable of covering upon the terminal slots of the seat; one long side of the cover having a plurality of notches; each notch being passed by a shaft for being received within the hook portion of the front insertion elastic sheet and being hindered by the hook portion of the rear insertion elastic sheet; thereby the cover being openable or closable along the round shaft;

wherein the front insertion elastic sheets and rear insertion elastic sheets are made of elastic insulating materials and sizes of the recesses of the front insertion elastic sheets and rear insertion elastic sheets are larger than the soft bank wires or the soft circuit board.

2. The soft PC board connector as claimed in claim 1, wherein a gap is formed between each lateral wall and a lateral side of the plurality of terminal slots for receiving a respective enhancing sheet.

* * * * *